US009654880B2

(12) United States Patent
Fukuoka et al.

(10) Patent No.: US 9,654,880 B2
(45) Date of Patent: May 16, 2017

(54) SOUND GENERATOR AND ELECTRONIC DEVICE USING THE SAME

(71) Applicant: Kyocera Corporation, Kyoto-shi, Kyoto (JP)

(72) Inventors: Shuichi Fukuoka, Kirishima (JP); Noriyuki Kushima, Kirishima (JP); Kentarou Miyazato, Kagoshima (JP); Tooru Takahashi, Kirishima (JP); Yutaka Makino, Kirishima (JP); Atsushi Ishihara, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/771,172

(22) PCT Filed: Sep. 12, 2014

(86) PCT No.: PCT/JP2014/074270

§ 371 (c)(1),
(2) Date: Aug. 27, 2015

(87) PCT Pub. No.: WO2015/037712

PCT Pub. Date: Mar. 19, 2015

(65) Prior Publication Data

US 2016/0021464 A1 Jan. 21, 2016

(30) Foreign Application Priority Data

Sep. 13, 2013 (JP) ..... 2013-190784

(51) Int. Cl.

| | |
|---|---|
| ***H04R 25/00*** | (2006.01) |
| ***H04R 17/00*** | (2006.01) |
| ***H04R 1/28*** | (2006.01) |
| ***H04R 7/04*** | (2006.01) |
| ***H04R 1/34*** | (2006.01) |

(52) U.S. Cl.
CPC ..... *H04R 17/00* (2013.01); *H04R 1/28* (2013.01); *H04R 1/345* (2013.01); *H04R 7/04* (2013.01); *H04R 2499/11* (2013.01)

(58) Field of Classification Search
CPC ..... H04R 17/00; H04R 1/345; H04R 7/04; H04R 2499/11; H04R 1/28
(Continued)

(56) References Cited

U.S. PATENT DOCUMENTS 5,616,892 A * 4/1997 Ferralli ..... H04R 1/345 181/155
5,802,196 A * 9/1998 Nakamura ..... H04R 1/06 181/155
(Continued)

FOREIGN PATENT DOCUMENTS

JP SHO55-165570 U 11/1980
JP SHO63-078494 U 8/1988
(Continued)

OTHER PUBLICATIONS

International Search Report (Form PCT/ISA/210) mailed on Dec. 9, 2014 and issued for International Application No. PCT/JP2014/074270.

*Primary Examiner* — Duc Nguyen
*Assistant Examiner* — Sean H Nguyen
(74) *Attorney, Agent, or Firm* — Volpe and Koenig, P.C.

(57) ABSTRACT

A sound generator 30 includes a piezoelectric element 1, a vibrating body 3*a*, a reflection member 81, a reflection member 82, an opening 21, and an opening 22. The vibrating body 3*a* vibrates due to vibration of the piezoelectric element 1 and generates a sound. The reflection member 81 is disposed in a first direction from the vibrating body 3*a* so as to be inclined with respect to the vibrating body 3*a*. The reflection member 82 is disposed in a second direction, which is opposite to the first direction, from the vibrating
(Continued)

body 3*a* so as to face the reflection member 81 with the vibrating body 3*a* therebetween and so as to be inclined with respect to the vibrating body 3*a*. The opening 21 faces in a third direction. The opening 22 faces in a fourth direction, which is different from the third direction.

19 Claims, 12 Drawing Sheets

(58) Field of Classification Search
USPC ..... 381/160
See application file for complete search history.

(56) References Cited

U.S. PATENT DOCUMENTS

| | | | | |
|---|---|---|---|---|
| 2003/0003945 | A1* | 1/2003 | Saiki | H04M 1/03 455/550.1 |
| 2010/0119090 | A1* | 5/2010 | Graber | H04R 1/403 381/190 |
| 2013/0128130 | A1* | 5/2013 | Yamauchi | H04N 5/642 348/836 |
| 2013/0216076 | A1* | 8/2013 | Knudsen | H03F 3/2173 381/312 |

FOREIGN PATENT DOCUMENTS

| | | | |
|---|---|---|---|
| JP | 1990-023191 | U | 2/1990 |
| JP | 1990-120999 | U | 10/1990 |
| JP | 2002-330496 | A | 11/2002 |
| JP | 2003-152838 | A | 5/2003 |
| JP | 2004-23436 | A | 1/2004 |
| JP | 2010-147924 | A | 7/2010 |
| JP | 2012-100049 | A | 5/2012 |
| JP | 2012-209866 | A | 10/2012 |
| JP | 2012-244314 | A | 12/2012 |

* cited by examiner

SOUND GENERATOR AND ELECTRONIC DEVICE USING THE SAME

TECHNICAL FIELD

The present invention relates to a sound generator and an electronic device using the sound generator.

BACKGROUND ART

Speakers in which a piezoelectric element is attached to a diaphragm are known to date (see, for example, PTL 1).

CITATION LIST

Patent Literature

PTL 1: Japanese Unexamined Patent Application Publication No. 2004-23436

SUMMARY OF INVENTION

Technical Problem

However, existing speakers described above have a problem in that their sound quality is impaired because the sound level on the front side of the diaphragm, in particular, the sound level at low-frequencies, is reduced as a sound having an opposite phase emitted from the back side of the diaphragm travels around the speaker to the front side. In addition, there is a problem in that, if a baffle board is used to prevent traveling of a sound emitted from the back side of the diaphragm, which has an opposite phase, around the speaker to the front side, the size of a sound generator becomes larger.

An object of the present invention, which has been devised in view of such problems of the existing technologies, is to provide a compact sound generator that can generate a high-quality sound and an electronic device using the sound generator.

Solution to Problem

A sound generator according to the present invention includes a piezoelectric element that vibrates when an electric signal is input; a vibrating body including a first main surface and a second main surface opposite to the first main surface, the piezoelectric element being disposed on the vibrating body, the vibrating body vibrating due to vibration of the piezoelectric element and generating a sound; a first reflection member disposed in a first direction from the vibrating body and including a first surface that faces the vibrating body and that is inclined with respect to the first main surface of the vibrating body; a second reflection member disposed in a second direction, which is opposite to the first direction, from the vibrating body and including a second surface that faces the first surface of the first reflection member with the vibrating body therebetween and is inclined with respect to the second main surface of the vibrating body; a first opening facing in a third direction, which is different from the first direction, and connecting the first space, which is a space between the vibrating body and the first reflection member, to a space outside of the first space; and a second opening facing in a fourth direction, which is different from the second direction and the third direction, and connecting a second space, which is a space between the vibrating body and the second reflection member, to a space outside of the second space. The piezoelectric element is disposed at a position near the first reflection member and far from the second reflection member. The first reflection member includes a first through-hole extending through a portion of the first reflection member including at least part of a portion of the first reflection member facing the piezoelectric element.

An electronic device according to the present invention includes the sound generator, and an electronic circuit connected to the sound generator. The electronic device has a function of causing the sound generator to generate a sound.

Advantageous Effects of Invention

With the sound generator according to the present invention, a compact sound generator that can generate a high-quality sound can be obtained. With the electronic device according to the present invention, a compact electronic device that can generate a high-quality sound can be obtained.

DESCRIPTION OF EMBODIMENTS

Hereinafter, a sound generator and an electronic device using the sound generator according to embodiments of the present invention will described in detail with reference to the drawings.

First Embodiment

Figure 1:
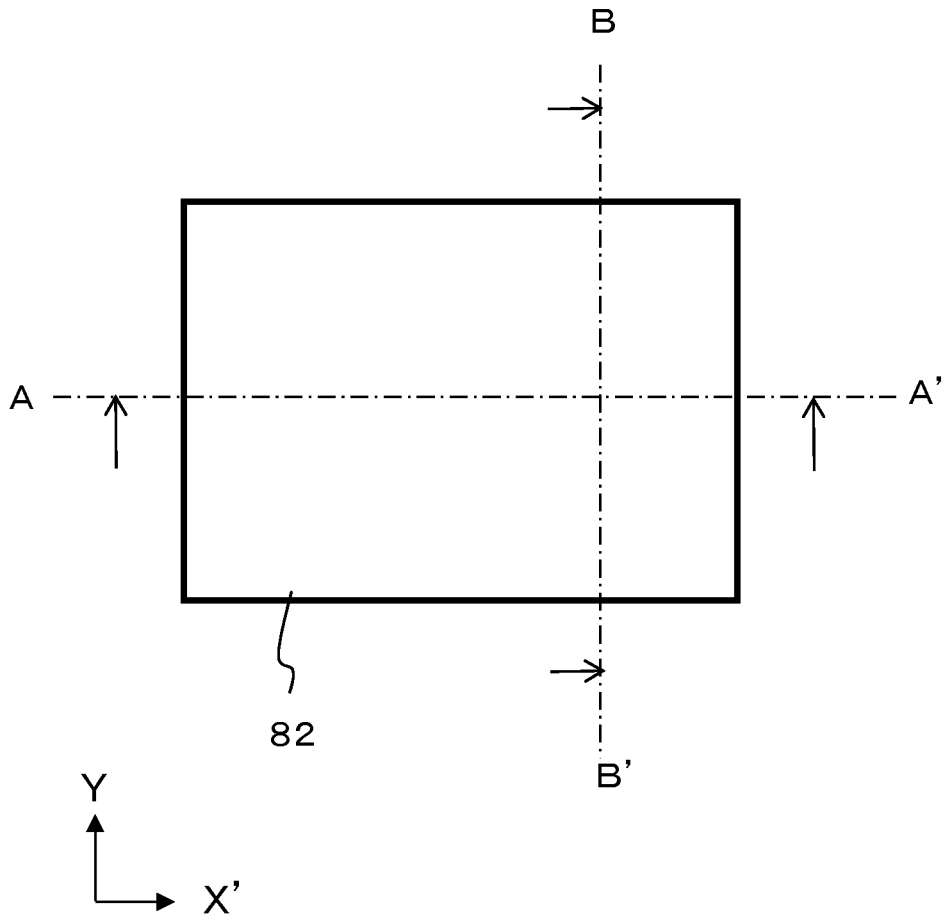
FIG. 1 is a schematic plan view of a sound generator according to a first embodiment of the present invention.
Figure 2:
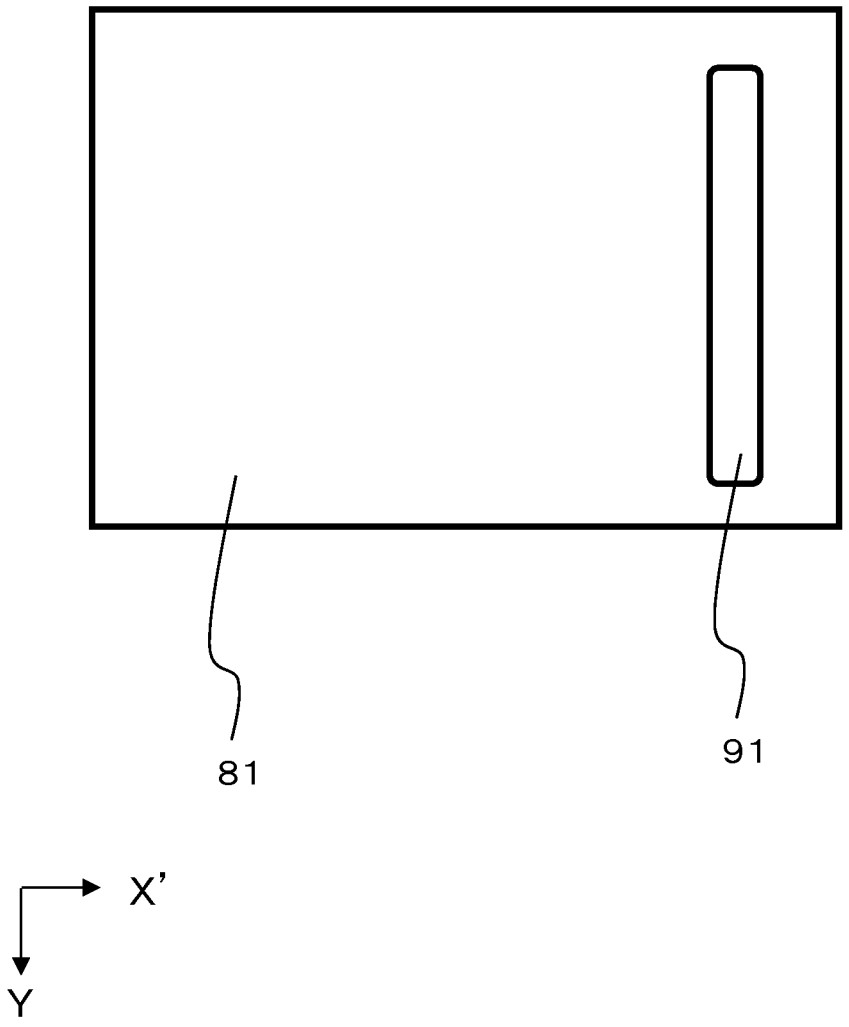
FIG. 2 is a schematic plan view of the sound generator according to the first embodiment of the present invention.
Figure 3:
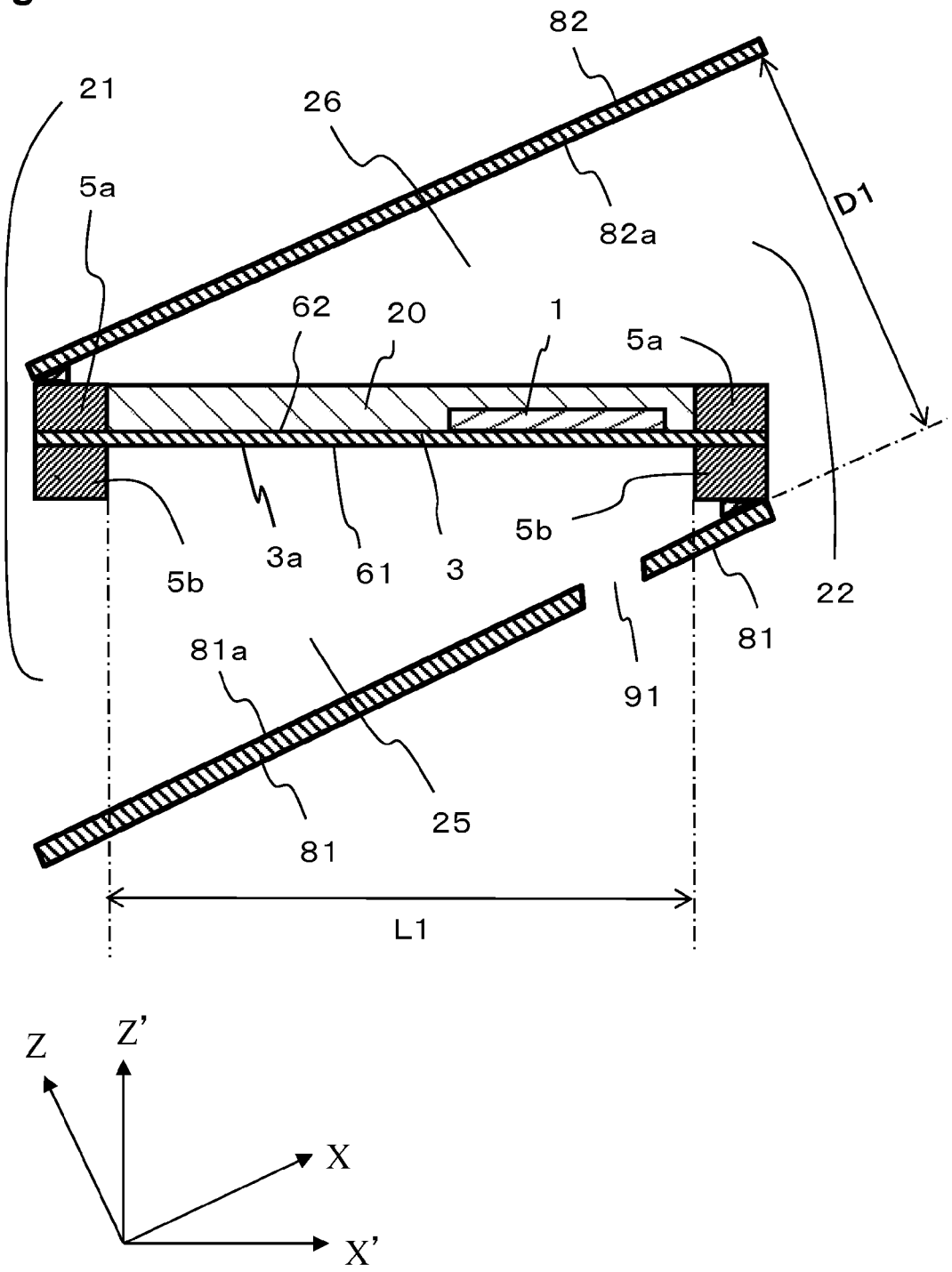
FIG. 3 is a sectional view taken along line A-A' of FIG. 1.
Figure 4:
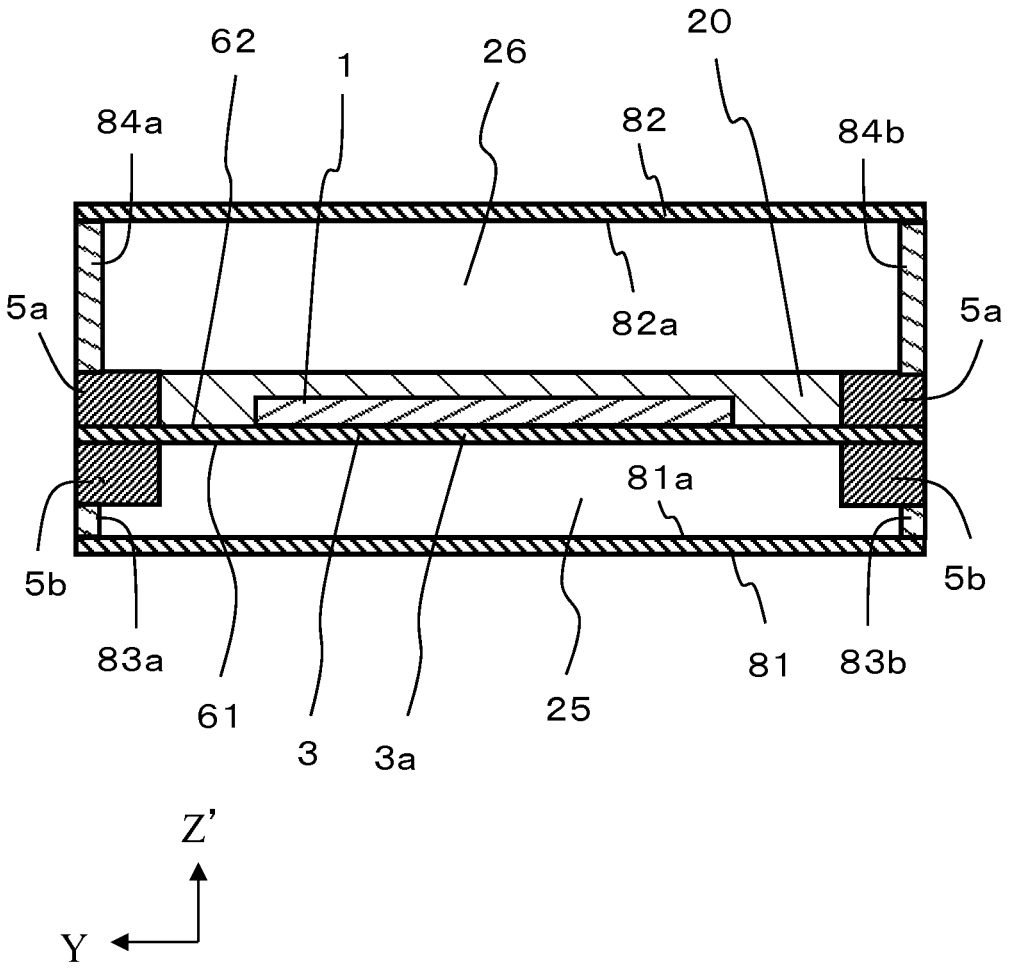
FIG. 4 is a sectional view taken along line B-B' of FIG. 1.

FIGS. 1 and 2 are schematic plan views of a sound generator according to a first embodiment of the present invention. FIG. 3 is a sectional view taken along line A-A' of FIG. 1. FIG. 4 is a sectional view taken along line B-B' of FIG. 1. In the figures, an XYZ orthogonal coordinate system and an X'YZ' orthogonal coordinate system are shown to indicate directions. The X'-axis is a coordinate axis obtained by rotating the X-axis around the Y-axis clockwise, and the Z'-axis is a coordinate axis obtained by rotating the Z-axis around the Y-axis clockwise. The angle through which the X'-axis is rotated from the X-axis is the same as the angle through which the Z'-axis is rotated from the Z-axis. FIG. 1 shows a state as seen from the +Z' direction, and FIG. 2 shows a state as seen from the −Z' direction.

Referring to FIGS. 1 to 4, the sound generator according to the present embodiment includes a piezoelectric element 1, a film 3, a frame member 5*a*, a frame member 5*b*, a resin layer 20, a reflection member 81, a reflection member 82, a reflection member 83*a*, a reflection member 83*b*, a reflection member 84*a*, a reflection member 84*b*, an opening 21, and an opening 22.

The frame members (5*a*, 5*b*) have rectangular frame-like shapes. An outer peripheral portion of the film 3 is clamped between the frame member 5*a* and the frame member 5*b* and is fixed in state in which a tension is applied to the film 3. The material of the frame members (5*a*, 5*b*) is not particularly limited and may be any material that is less deformable than the film 3 and the resin layer 20. For example, the frame members (5*a*, 5*b*) can be made from a rigid resin, a plastic, an engineering plastic, a ceramic material, a metal, or the like. For example, the frame members (5*a*, 5*b*) may have a thickness in the range of 100 to 1000 μm and may be made of a stainless steel. The internal shapes of the frame members (5*a*, 5*b*) are not limited to rectangular and may be elliptical or rhombic. The frame member 5*b* may be omitted. If the frame member 5*b* is omitted, for example, the film 3 may be bonded to a surface of the frame member 5*a* facing in the −Z' direction.

The film 3, whose rectangular peripheral edge portion is entirely clamped between the frame member 5*a* and the frame member 5*b*, is fixed in a state in which a tension is applied to the film 3. The film 3 is supported by the frame members (5*a*, 5*b*) so that the film 3 can vibrate. A portion of the film 3 that is located inside the frame members (5*a*, 5*b*) and that can vibrate functions as a vibrating body 3*a*, to which the piezoelectric element 1 is attached and which vibrates together with the piezoelectric element 1. Thus, the vibrating body 3*a* is planar and has a main surface 61 and a main surface 62. The thickness of the film 3 is, for example, in the range of 10 to 200 μm. The film 3 can be made of, for example, a resin, such as polyethylene, polyimide resin, polypropylene, and polystyrene. The film 3 may be made from paper that is made of pulp, fiber, or the like.

The piezoelectric element 1 has a planar shape. Two main surfaces of the piezoelectric element 1 (a surface facing in the +Z' direction and a surface facing in the −Z' direction) have rectangular shapes that are long in the +Y direction and short in the +X' direction. Although detailed illustration of the piezoelectric element 1 is omitted, the piezoelectric element 1 includes a stacked body, a plurality of surface electrodes, and a plurality of side electrodes. The stacked body is made by alternately stacking piezoelectric layers, which are made of a piezoelectric ceramic material, and internal electrode layers in the +Z' direction. The plurality of surface electrodes are respectively disposed on two main surfaces of the stacked body. The plurality of side electrodes are respectively disposed on a surface of the stacked body facing in the +Y direction and a surface of the stacked body facing in the −Y direction. The surface electrodes and the internal electrode layers are alternately drawn out to the surface of the stacked body facing in the +Y direction and the surface of the stacked body facing in the −Y direction and are respectively connected to the side electrodes.

The piezoelectric element 1 is a bimorph piezoelectric element, which extends or contracts oppositely in the +Z' direction or the −Z' direction at any moment when an electric signal is input. Thus, the piezoelectric element 1 performs flexural vibration when an electric signal is input. The piezoelectric element 1 is bonded to the film 3 by using, for example, a known adhesive, such as epoxy resin, a silicone resin, or a polyester resin; a double sided tape; or the like. Thus, when an electric signal is input and the piezoelectric element 1 vibrates, the vibrating body 3*a*, which is a portion of the film 3 inside the frame members (5*a*, 5*b*), vibrates together with the piezoelectric element 1. The piezoelectric element 1 may be a monomorphic vibration element, which is made by bonding a piezoelectric element, which extends and contracts when an electric signal is input, to a metal plate.

The piezoelectric layers of the piezoelectric element 1 can be made from an existing piezoelectric ceramic material, such as lead zirconate (PZ); lead zirconate titanate (PZT); lead-free piezoelectric materials, including Bi-layered compound or tungsten bronze structure compound; or the like. Preferably, the thickness of each piezoelectric layer is, for example, in the range of about 10 to 100 μm.

The internal electrode layers of the piezoelectric element 1 can be made from any of various known metal materials. For example, the internal electrode layers may include a metal component, including silver and palladium, and a material component of the piezoelectric layers. The surface electrodes and the side electrodes of the piezoelectric element 1 can be made from any of various known metal materials. For example, the surface electrodes and the side electrodes can be made from a material including a metal component including silver and a glass component.

The entirety of the space inside the frame member 5*a* is filled with the resin layer 20 so that the piezoelectric element 1 is embedded in the resin layer 20. The resin layer 20 can be made from any of various known materials. For example, the resin layer 20 can be made from a resin, such as an acrylic resin or a silicone resin; a rubber; or the like. Preferably, in order to suppress spurious vibration, the resin layer 20 has a thickness with which the resin layer 20 completely covers the piezoelectric element 1.

The reflection member 81 has a planar shape. The reflection member 81 is disposed in the −Z direction from the vibrating body 3*a*, is inclined with respect to the main surface 61 of the vibrating body 3*a*, and is attached to the frame member 5*b*. The reflection member 81 has a surface 81*a*. The surface 81*a* of the reflection member 81 faces the vibrating body 3*a* and is inclined with respect to the main surface 61 of the vibrating body 3*a*. The reflection member 81 reflects a sound generated from the main surface 61 of the vibrating body 3*a* in the −X' direction. The reflection member 82 has a planar shape. The reflection member 82 is disposed in the +Z direction from the vibrating body 3*a*, is inclined with respect to the main surface 62 of the vibrating body 3*a*, and is attached to the frame member 5*a*. The reflection member 82 has a surface 82*a*. The surface 82*a* of the reflection member 82 faces the surface 81*a* of the reflection member 81 with the vibrating body 3*a* therebetween and is inclined with respect to the surface 62 of the vibrating body 3*a*. The reflection member 82 reflects a sound generated from the main surface 62 of the vibrating body 3*a* in the +X' direction. The reflection member 81 has a through-hole 91 extending through the reflection member 81. The through-hole 91 extends through a portion of the reflection member 81 including at least part of a portion of the reflection member 81 facing the piezoelectric element 1.

The reflection member 83*a* and the reflection member 83*b* have planar shapes and are disposed in the −Z' direction from the vibrating body 3*a*. The reflection member 83*a* connects the frame member 5*b* to the reflection member 81 at an end in the +Y direction, and the reflection member 83*b* connects the frame member 5*b* to the reflection member 81 at an end in the −Y direction. In other words, the reflection member 83*a* and the reflection member 83*b* connect the vibrating body 3*a* to the reflection member 81 through the frame member 5*b*. A space 25 between the vibrating body 3*a* and the reflection member 81 is surrounded by the vibrating body 3*a*, the frame member 5*b*, the reflection member 81, the reflection member 83*a*, and the reflection member 83*b*. At an end in the −X' direction, the opening 21, which faces in the −X' direction, is formed. The opening 21 connects the space 25 to a space outside of the space 25.

The reflection member 84*a* and the reflection member 84*b* have planar shapes and are disposed in the +Z' direction from the vibrating body 3*a*. The reflection member 84*a* connects the frame member 5*a* to the reflection member 82 at an end in the +Y direction, and the reflection member 84*b* connects the frame member 5*a* to the reflection member 82 at an end in the −Y direction. In other words, the reflection member 84*a* and the reflection member 84*b* connect the vibrating body 3*a* to the reflection member 82 through the frame member 5*a*. A space 26 between the vibrating body 3*a* and the reflection member 82 is surrounded by the vibrating body 3*a*, the frame member 5*a*, the reflection member 82, the reflection member 84*a*, and the reflection member 84*b*. At an end in the +X' direction, the opening 22, which faces in the +X' direction, is formed. The opening 22 connects the space 26 to a space outside of the space 26.

The frame members (5*a*, 5*b*) function as a reflection member that partitions a space between the reflection member 81 and the reflection member 82 into a space on the reflection member 81 side and a space on the reflection member 82 side. The vibrating body 3*a* is disposed so as to cover a through-hole of the frame members (5*a*, 5*b*).

The reflection members (81, 82, 83*a*, 83*b*, 84*a*, 84*b*) can be made from, for example, various materials, such as a synthetic resin, a wood, a metal, and a ceramic material. The shapes of the reflection members (81, 82, 83*a*, 83*b*, 84*a*, 84*b*) in plan view are not particularly limited and may be any of various shapes. The thicknesses of the reflection members (81, 82, 83*a*, 83*b*, 84*a*, 84*b*) are not particularly limited and may be, for example, in the range of about 1 mm to 100 mm.

As described above, the sound generator according to the present embodiment includes the piezoelectric element 1, the vibrating body 3*a*, the reflection member 81, the reflection member 82, the opening 21, and the opening 22. The vibrating body 3*a* has the main surface 62 and the main surface 62 opposite to the main surface 61, the piezoelectric element 1 is disposed on the vibrating body 3*a*, and the vibrating body 3*a* vibrates due to vibration of the piezoelectric element 1 and generates a sound. The reflection member 81 is disposed in the −Z direction from the vibrating body 3*a* and has the surface 81*a*. The surface 81*a* of the reflection member 81 faces the vibrating body 3*a* and is inclined with respect to the main surface 61 of the vibrating body 3*a*. The reflection member 82 is disposed in the +Z direction, which is opposite to the −Z direction, from the vibrating body 3*a* and has the surface 82*a*. The surface 82*a* of the reflection member 82 faces the surface 81*a* of the reflection member 81 with the vibrating body 3*a* therebetween and is inclined with respect to the surface 62 of the vibrating body 3*a*. The opening 21 faces in the −X' direction, which is different from the −Z direction. The opening 21 connects the space 25, which is a space between the vibrating body 3*a* and the reflection member 81, to a space outside of the space 25. The opening 22 faces in the +X' direction, which is different from the +Z direction and the −X' direction. The opening 22 connects the space 26, which is a space between the vibrating body 3*a* and the reflection member 82, to a space outside of the space 26. With such a structure, the sound generator according to the present embodiment is compact and can generate a high-quality sound. The reason for such an effect is considered that interference between sounds having different phases can be reduced, without using a large baffle board or enclosure, by emitting a sound generated from the main surface 61 of the vibrating body 3*a* and a sound emitted from the main surface 62 of the vibrating body 3*a* in different directions each with increased directivity.

In the sound generator according to the present embodiment, the piezoelectric element 1 is disposed at a position near the reflection member 81 and far from the reflection member 82. The reflection member 81 has the through-hole 91 extending through the reflection member 81. The through-hole 91 extends through a portion of the reflection member 81 including at least part of a portion of the reflection member 81 facing the piezoelectric element 1. With such a structure, the sound generator according to the present embodiment can reduce decrease of sound quality that occurs when the piezoelectric element 1 is too close to the reflection member 81 and the reflection member 82. The reason for such an effect, although not clearly specified, can be estimated as follows. That is, the sound pressure of a sound generated by the vibrating body 3*a* is the largest at a position at which the piezoelectric element 1 is attached to the vibrating body 3*a*. Thus, if the position at which the piezoelectric element 1 is attached is too close to the reflection member 81 or the reflection member 82, reverberation between the vibrating body 3*a* and the reflection member 81 or the reflection member 82 becomes strong and the sound quality decreases (the sound becomes harsh and unpleasant). By disposing the piezoelectric element 1 at a position far from the reflection member 82, reverberation between the vibrating body 3*a* and the reflection member 82 can be reduced, and, by forming the through-hole 91 in a portion of the reflection of the reflection member 81 including at least part of a portion of the reflection member 81 facing the piezoelectric element 1, reverberation between the vibrating body 3*a* and the reflection member 81 can be reduced. Thus, the sound generator according to the present embodiment can generate a high-quality sound.

The phrase "the opening 21 faces in the −X' direction" means that the opening 21 can be seen from the −X' direction. The phrase, "a portion of the reflection member 81 facing the piezoelectric element 1" refers to a portion of the reflection member 81 in which a line that extends from the piezoelectric element 1 perpendicularly to the reflection member 81 intersects the reflection member 81. The phrase "the piezoelectric element 1 is disposed at a position near the reflection member 81 and far from the reflection member 82" means that the distance between the piezoelectric element 1 and the reflection member 81 is smaller than the distance between the piezoelectric element 1 and the reflection member 82.

In the sound generator according to the present embodiment, when the +X' direction is defined as a direction along the main surface 62 of the vibrating body 3*a* and −X' direction is defined as a direction opposite to the +X' direction, an end of the vibrating body 3*a* in the +X' direction is close to the reflection member 81 and an end of the vibrating body 3*a* in the −X' direction is close to the reflection member 82, and the piezoelectric element 1 is disposed at a position on the vibrating body 3*a* displaced in the +X' direction. Thus, the vibrating body 3*a* can have a size across the entirety of a space between the reflection member 81 and the reflection member 82, and the piezoelectric element 1 can be disposed at a position far from the reflection member 82. Thus, the sound generator according to the present embodiment is compact but can generate a high-sound-pressure and high-quality sound.

In the sound generator according to the present embodiment, when the distance between the reflection member 81 and the reflection member 82 is denoted by D1 and the length of the vibrating body 3*a* in the +X' direction is denoted by L1, D1<L1. Thus, the size of the vibrating body 3*a* can be increased while reducing the distance between the reflection member 81 and the reflection member 82, and therefore a compact sound generator that has a high sound pressure at low frequencies can be obtained.

In the sound generator according to the present embodiment, when the +Y direction is defined as a direction along the main surface 62 of the vibrating body 3*a* and perpendicular to the +X' direction, the length of the piezoelectric element 1 in the +Y direction is larger than the length of the piezoelectric element 1 in the +X' direction. Thus, the length of the piezoelectric element 1 can be increased while maintaining a large distance between the piezoelectric element 1 and the reflection member 82, and therefore the sound pressure at low frequencies can be increased while suppressing decrease of sound quality.

In the sound generator according to the present embodiment, the through-hole 91 is selectively formed in a portion of the reflection member 81 that is closest to the piezoelectric element 1. Thus, while suppressing decrease of sound quality, overall decrease of the sound pressure of a sound emitted from the opening 21 can be prevented.

The sound generator according to the present embodiment can be manufactured, for example, as follows. First, slurry is made by adding a binder, a dispersant, a plasticizer, and a solvent to powder of a piezoelectric material and by mixing them together. Any of leas-based piezoelectric materials and lead-free piezoelectric materials can be used. Next, a green sheet is made by forming the obtained slurry into a sheet-like shape. A conductor pattern, which is to become an internal electrode, is formed on the green sheet by applying a conductive paste to the green sheet. A stacked compact is made by stacking such green sheets having conductor patterns.

Next, the stacked compact is degreased, fired, and cut into a predetermined size, and thereby a stacked body can be obtained. As necessary, the outer periphery of the stacked body is processed. Next, on the main surfaces of the stacked body facing in the stacking direction, conductive patterns, which are to become surface electrodes, are formed by applying a conductor paste to the surfaces. Conductive patterns, which are to become side electrodes, are formed by applying a conductor paste to both side surfaces of the stacked body extending in the longitudinal direction (+Y direction). By baking the electrodes at a predetermined temperature, a structure to become the piezoelectric element 1 can be obtained. Subsequently, in order to provide the piezoelectric element 1 with piezoelectric property, the piezoelectric layers of the piezoelectric element 1 are polarized by applying a direct-current voltage through the surface electrodes or the side electrodes. Thus, the piezoelectric element 1 can be obtained.

Next, the film 3 and the frame members (5*a*, 5*b*) are prepared, and, in a state in which a tension is applied to the film 3, the peripheral edge of the film 3 is clamped between the frame member 5*a* and the frame member 5*b* and fixed to the frame members 5*a* and 5*b* by using an adhesive. Next, the piezoelectric element 1 is joined to a surface of the film 3 by using an adhesive or the like, and wires are connected to the piezoelectric element 1. The resin layer 20 is formed by filling the space inside the frame member 5*a* with a resin and by curing the resin. The reflection members (81, 82, 83*a*, 83*b*, 84*a*, 84*b*), which have been formed into predetermined shapes, are joined to the frame member 5*a* by using an adhesive or the like. Thus, the sound generator according to the present embodiment can be obtained.

Second Embodiment

Figure 5:
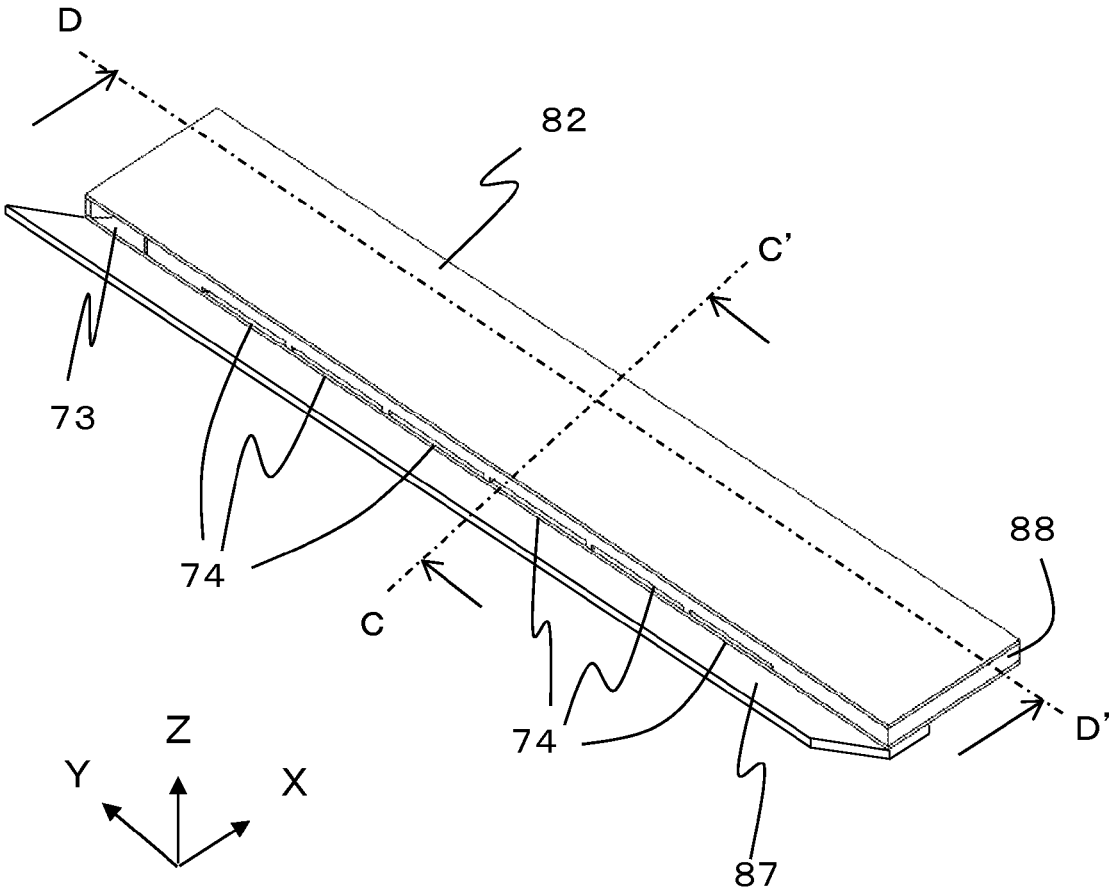
FIG. 5 is a schematic perspective view of a sound generator according to a second embodiment of the present invention.
Figure 6:
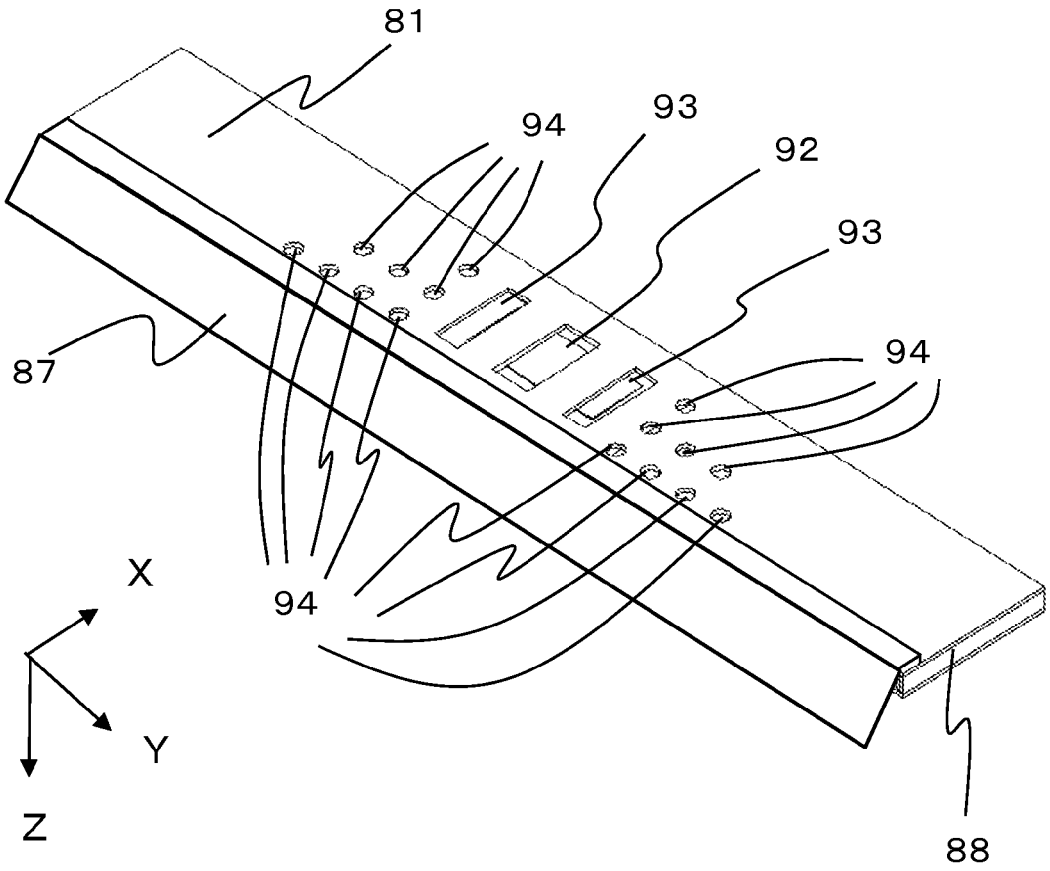
FIG. 6 is a schematic perspective view of the sound generator according to the second embodiment of the present invention.
Figure 7:
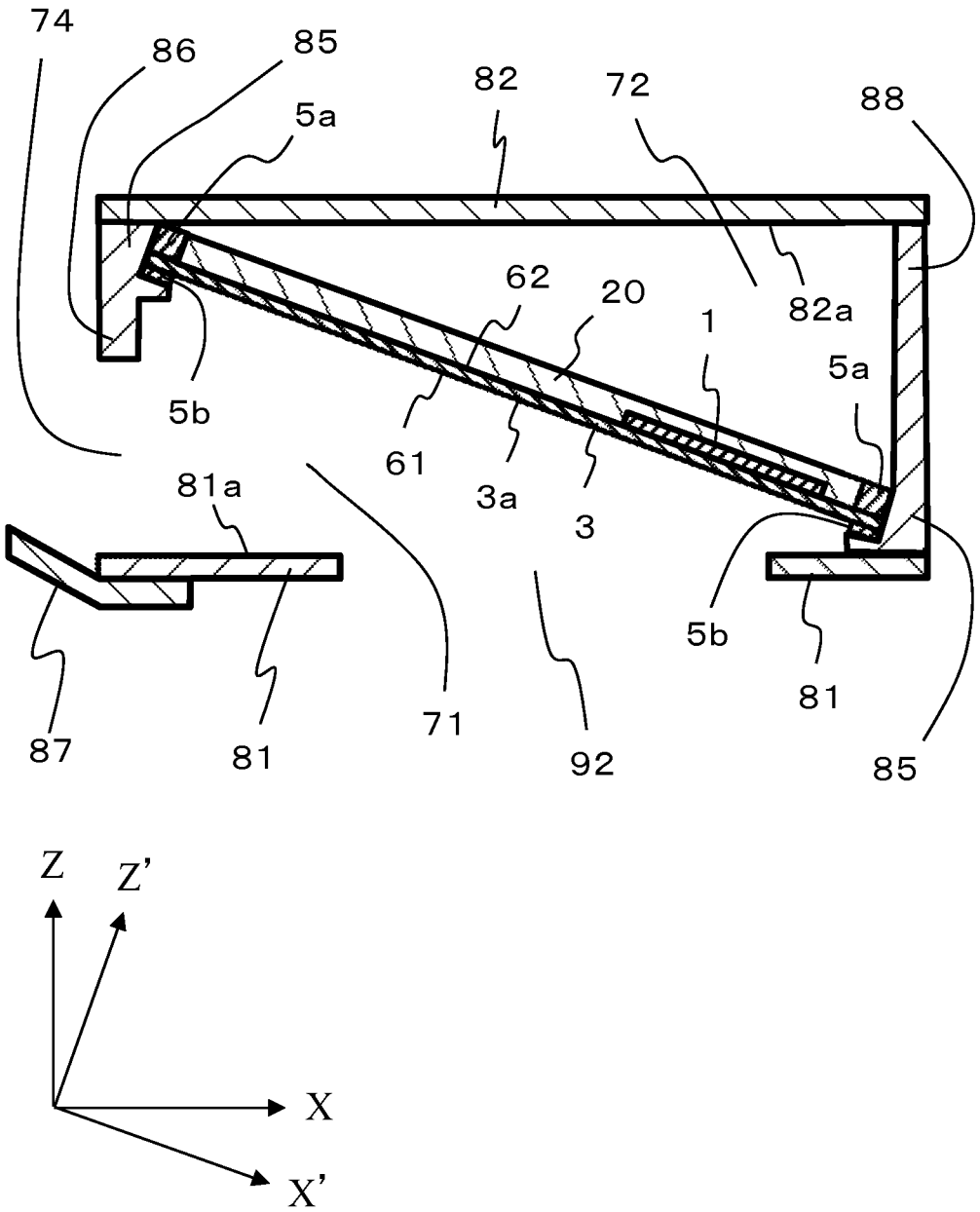
FIG. 7 is a sectional view taken along line C-C' of FIG. 5.
Figure 8:
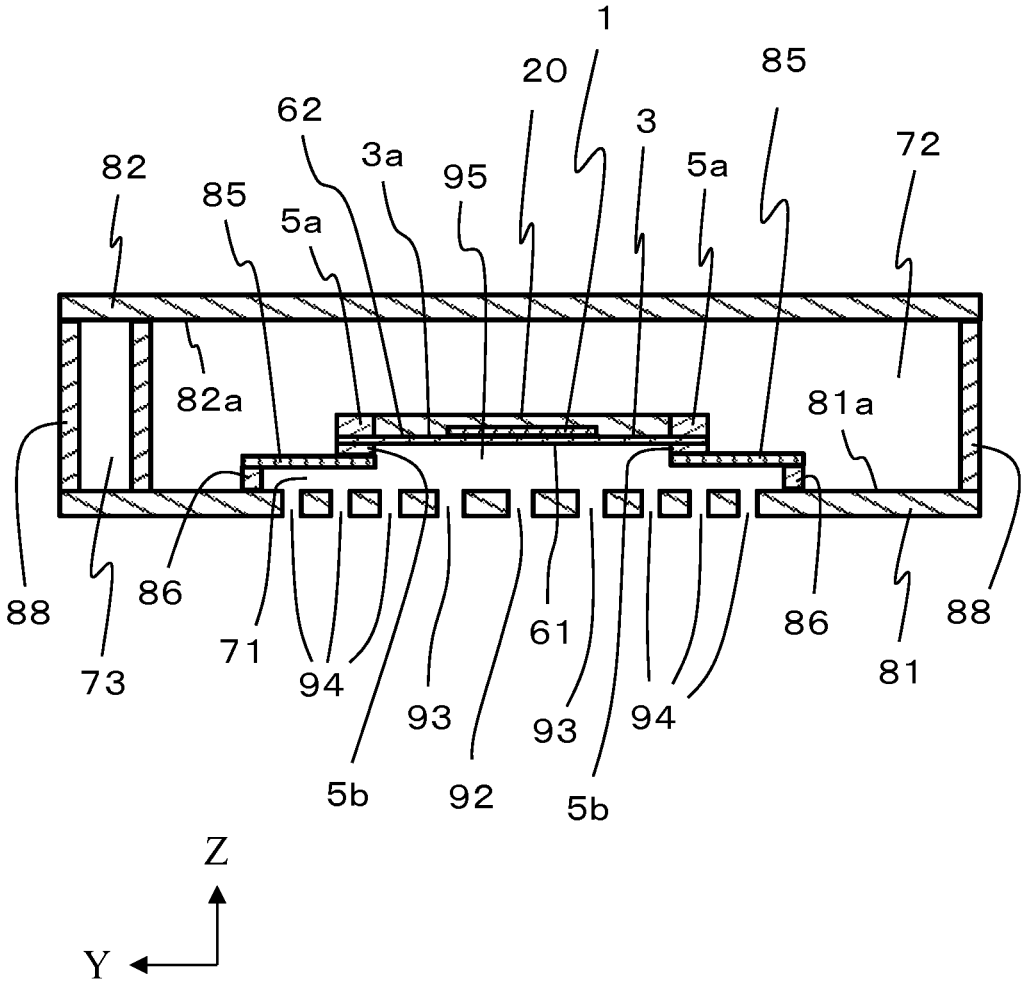
FIG. 8 is a sectional view taken along line D-D' of FIG. 5.
Figure 9:
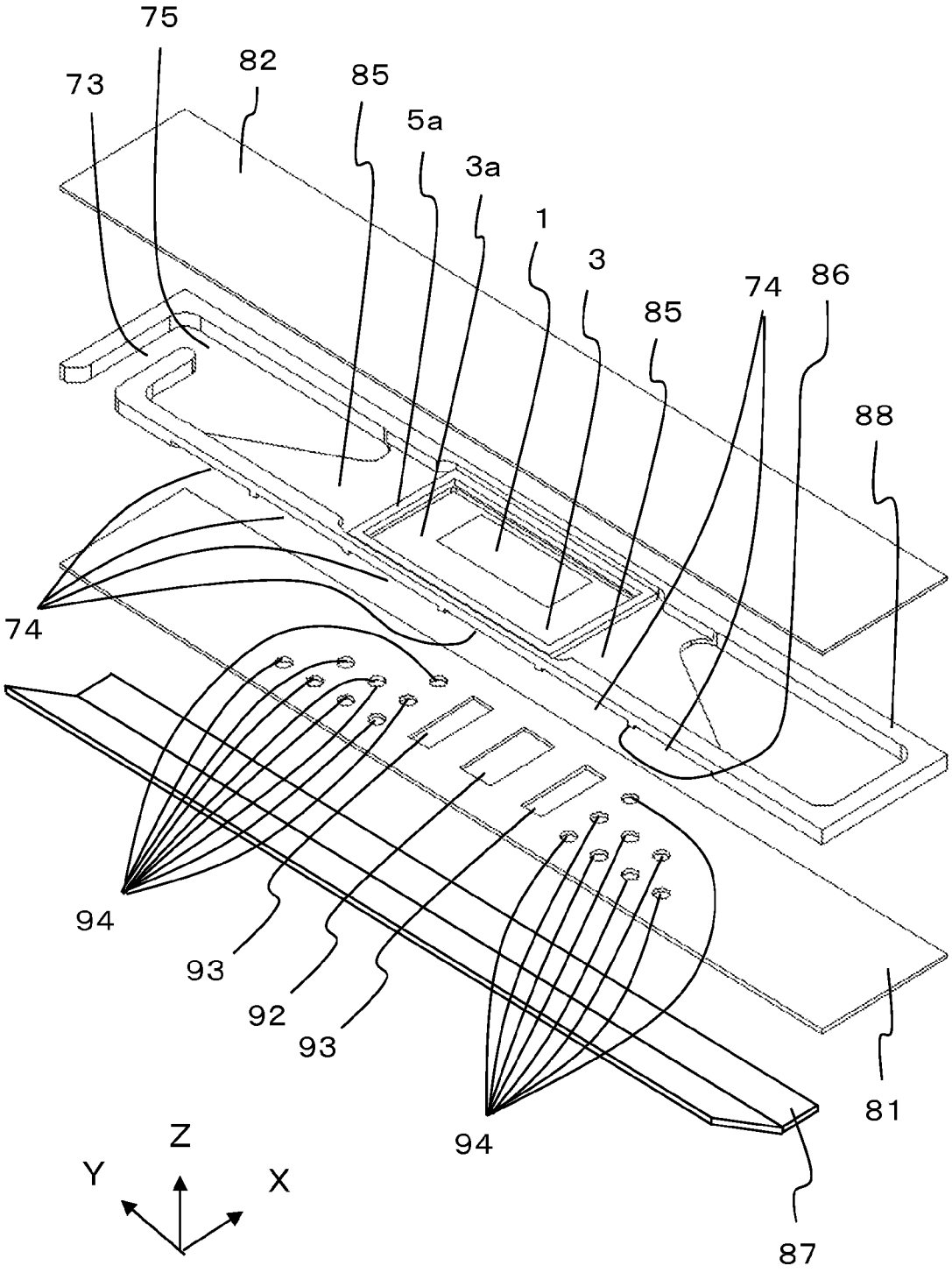
FIG. 9 is a schematic exploded perspective view of the sound generator according to the second embodiment of the present invention.

Next, a sound generator according to a second embodiment of the present invention will be described with reference to FIGS. 5 to 9. FIGS. 5 and 6 are schematic perspective views of the sound generator according to the second embodiment of the present invention. FIG. 7 is a sectional view taken along line C-C' of FIG. 5. FIG. 8 is a sectional view taken along line D-D' of FIG. 5. FIG. 9 is a schematic exploded perspective view of the sound generator according to the second embodiment of the present invention. In the present embodiment, differences from the sound generator according to the first embodiment described above will be described. The same elements will be denoted by the same numerals, and redundant descriptions will be omitted.

The sound generator according to the present embodiment does not include the reflection member 83*a*, the reflection member 83*b*, the reflection member 84*a*, and the reflection member 84*b*, which are included in the sound generator according to the first embodiment. Instead, the sound generator according to the present embodiment includes a reflection member 85, a reflection member 86, a reflection member 87, and a reflection member 88. The shapes of the reflection member 81 and the reflection member 82 differ from those of the sound generator according to the first embodiment described above.

The reflection member 85 is disposed in part of a region (a middle portion in the +Y direction) in which the reflection member 81 and the reflection member 82 overlap when seen from the +Z direction or in the −Z direction, and the reflection member 85 partitions a space between the reflection member 81 and the reflection member 82 into a space on the reflection member 81 side and a space on the reflection member 82 side. The reflection member 85 is inclined with respect to the reflection member 81 and the reflection member 82 in the same way as the vibrating body 3*a* is. The phrase "inclined in the same way" means that they are inclined in the same direction at the same angle. However, the direction or the angle need not exactly coincide and may differ within a manufacturing tolerance. A through-hole 95 is formed in a middle portion of the reflection member 85. By joining the frame member 5*b* to the periphery of the through-hole 95, the vibrating body 3*a* is attached to the reflection member 85 so as to cover the through-hole 95.

The reflection member 86*a* extends in the −Z direction from a peripheral edge of the reflection member 85 toward the reflection member 81 and connects the reflection member 85 to the reflection member 81. Thus, a space 71, which is surrounded by the reflection member 81, the reflection member 85, the reflection member 86, the frame member 5*b*, and the vibrating body 3*a*, is formed. A plurality of openings 74, which connect the space 71 to a space outside of the space 71, are formed in the reflection member 86, which is located at an end of the space 71 in the −X direction. A sound generated from the main surface 61 of the vibrating body 3*a* is emitted through the opening 74.

The reflection member 88 extends in the +Z direction from a peripheral edge of the reflection member 81 toward a peripheral edge of the reflection member 82 and connects the reflection member 81 to the reflection member 82. Thus, a space 72, which is surrounded by the reflection member 81, the reflection member 82, the reflection member 85, the reflection member 86, the reflection member 88, the frame member 5*a*, the frame member 5*b*, and the vibrating body 3*a*, is formed. An opening 75, which connects the space 72 to a space outside of the space 72, is formed in the reflection member 88, which is located at an end of the space 72 in the +Y direction. A duct 73 is connected to the opening 75. The duct 73 has an opening facing in the −X direction.

The reflection member 87, which is inclined in the +Z direction, is attached to an end portion, in the −X direction, of a main surface of the reflection member 81 facing in the −Z direction. Sounds emitted from the duct 73 and the plurality of openings 74 are reflected by the reflection member 87 in the +Z direction.

One through-hole 92, two through-holes 93, and a plurality of through-holes 94 are formed in the reflection member 81. Each of the through-hole 92 and the two through-holes 93 extends through a portion of the reflection member 81 including at least part of a portion of the reflection member 81 facing the piezoelectric element 1. Each of the through-hole 92 and the two through-holes 93 has a shape that is long in the +X direction. The through-hole 92 and the two through-holes 93 are disposed with a distance between the through-hole 92 and each of the through-holes 93 in the +Y direction. The through-hole 92 is located between the two through-holes 93. Each of the through-holes 94 is circular and has a cross-sectional area smaller than that of each of the through-hole 92 and the through-holes 93. The plurality of through-holes 94 are formed in a region of the reflection member 81 that is in contact with the space 71 and that does not face the piezoelectric element 1.

As described above, the sound generator according to the present embodiment includes the reflection member 85, the reflection member 86, and the reflection member 88. The reflection member 85 is disposed in part of a region in which the reflection member 81 and the reflection member 82 overlap when seen from the +Z direction or from the −Z direction, and the reflection member 85 partitions the space between the reflection member 81 and the reflection member 82 into the space on the reflection member 81 side and the space on the reflection member 82 side. The reflection member 86 connects the reflection member 85 to the reflection member 81. The reflection member 88 connects the reflection member 81 to the reflection member 82. The through-hole 95 is formed in the reflection member 85, and the vibrating body 3*a* is attached to the reflection member 85 so as to cover the through-hole 95. The openings 74 connect the space 71, which is surrounded by the vibrating body 3*a*, the reflection member 81, the reflection member 85, and the reflection member 86, to the space outside of the space 71. The openings 75 connect the space 72, which is surrounded by the reflection member 81, the reflection member 82, the reflection member 85, the reflection member 86, the reflection member 88, and the vibrating body 3*a*, to the space outside of the space 72. The duct 73 is connected to the opening 75. With such a structure, a sound generated from the main surface 61 of the vibrating body 3*a* is emitted from the openings 74, and a sound generated from the main surface 62 of the vibrating body 3*a* can be emitted after causing the sound to reverberate in the space 72 and changing the phase of the sound through the duct 73. Thus, the sound pressure of the emitted sound in a low frequency range can be increased.

The sound generator according to the present embodiment has one through-hole 92 and one or more through-holes 93. The through-hole 92 and the through-holes 93 extend in the portion of the reflection member 81 including at least part of the portion of the reflection member 81 facing the piezoelectric element 1. When the +X direction is defined as a direction along the main surface of the reflection member 81 and perpendicular to the +Y direction, the length of each of the through-hole 92 and the through-holes 93 is larger than that in the +Y direction. Each through-hole 93 is disposed with a distance between the through-hole 93 and the through-hole 92 in the +Y direction. With such a structure, decrease of sound quality is suppressed by using the through-hole 92 and the through-holes 93, and the level of a sound in a low-frequency range that leaks through the through-hole 92 and the through-holes 93 can be reduced.

The sound generator according to the present embodiment includes the reflection member 87, which reflects both of a sound emitted from the opening 74 and a sound emitted from the duct 73. With such a structure, a thin sound generator, which has a compact size in the direction in which it emits a sound (+Z direction), can be obtained.

In the sound generator according to the present embodiment, the plurality of through-holes 94 are formed in the reflection member 81. The plurality of through-holes 94 are formed in the region of the reflection member 81 that is in contact with the space 71 and that does not face the piezoelectric element 1. Each through-hole 94 is circular and has a cross-sectional area smaller than that of each of the through-hole 92 and the through-holes 93. The plurality of through-holes 94 are arranged so that the number thereof increases toward the opening 74. With such a structure, the quality of generated sound can be further improved.

In the sound generator according to the present embodiment, the length of the space 71 in the +Y direction increases toward the opening 74. Thus, the sound pressure of a sound generated from the main surface 61 of the vibrating body 3*a* can be increased, and, by maximally increasing the volume of the space 72, the sound pressure of a sound emitted through the duct 73 can be increased.

Third Embodiment

Figure 10:
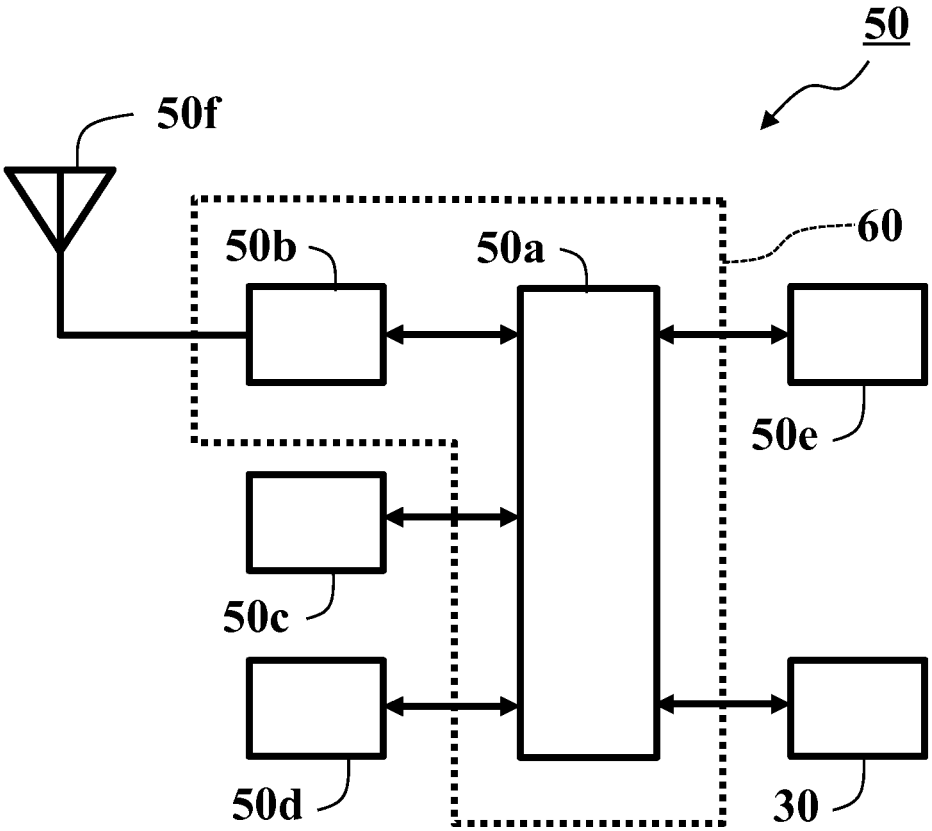
FIG. 10 is a block diagram showing the structure of an electronic device according to a third embodiment of the present invention.

FIG. 10 is a block diagram showing an example of the structure of an electronic device 50 according to a third embodiment of the present invention.

Referring to FIG. 10, the electronic device 50 according to the present embodiment includes a sound generator 30, an electronic circuit 60, a key input unit 50*c*, a microphone input unit 50*d*, a display unit 50*e*, and an antenna 50*f*. FIG. 10 is a block diagram of an electronic device that is supposed to be, for example, a mobile phone, a tablet terminal, or a personal computer.

The electronic circuit 60 includes a control circuit 50*a* and a communication circuit 50*b*. The electronic circuit 60 is connected to the sound generator 30 and has a function of outputting an audio signal to the sound generator. The control circuit 50*a* is a controller of the electronic device 50.

The communication circuit 50*b* sends and receives data through the antenna 50*f* on the basis of control of the control circuit 50*a*.

The key input unit 50*c* is an input device of the electronic device 50 and accepts a key input operation by an operator. The microphone input unit 50*d* is also an input device of the electronic device 50 and accepts an audio input operation or the like by an operator. The display unit 50*e* is a display output device of the electronic device 50 and outputs display information on the basis of control by the control circuit 50*a*.

The sound generator 30 is the sound generator according to the first embodiment or the second embodiment described above. The sound generator 30 functions as an audio output device of the electronic device 50 and generates a sound (including a sound outside of the audio-frequency range) on the basis of an electric signal input from the electronic circuit 60, which includes audio information. The sound generator 30 is connected to the control circuit 50*a* of the electronic circuit 60 and generates a sound when a voltage controlled by the control circuit 50*a* is applied to the sound generator 30.

The electronic device 50 according to the present embodiment, which generates a sound by using the sound generator 30 according to the first embodiment or the second embodiment, can generate a high-quality sound with a compact size.

As an example of the structure of the electronic device 50, for example, the electronic device 50 may include a housing in which the electronic circuit 60, the key input unit 50*c*, the microphone input unit 50*d*, the display unit 50*e*, the antenna 50*f*, and the sound generator 30, which are shown in FIG. 10, are disposed. As another example of the structure of the electronic device 50, the electronic device 50 may include a device body, and the sound generator 30 may be connected to the device body through lead wires or the like so that an electric signal can be transmitted. The device body includes a housing in which the electronic circuit 60, the key input unit 50*c*, the microphone input unit 50*d*, the display unit 50, and the antenna 50*f*, which are shown in FIG. 10, are disposed.

The electronic device according to the present embodiment need not include all of the key input unit 50*c*, the microphone input unit 50*d*, the display unit 50*e*, and the antenna 50*f*, which are shown in FIG. 10. The electronic device may include at least the sound generator 30 and the electronic circuit 60. The electronic device 50 may include other elements. The electronic circuit 60 is not limited to the electronic circuit 60 having the structure described above and may be an electronic circuit having a different structure.

The electronic device according to the present embodiment is not limited to an electronic device, such as a mobile phone, a tablet terminal, or a personal computer described above. The sound generator 30 according to the first embodiment or the second embodiment described above can be used in various electronic devices having a function of generating a sound or a voice, such as a television set, an audio system, a radio, a vacuum cleaner, a refrigerator, and a microwave oven.

(Modifications)

The present invention is not limited to the embodiments described above and can be modified or improved in various ways within the spirit and scope of the present invention.

In the embodiments described above, the film 3 is used as the vibrating body 3*a*. However, the vibrating body 3*a* is not limited to a film. For example, instead of the film 3, for example, a plate-shaped member made of a metal, a ceramic material, a synthetic resin, or the like may be used. A film-shaped object made of any of various rubber materials may be used.

In the embodiments described above, the resin layer 20, which covers the surfaces of the film 3 and the piezoelectric element 1, is formed. However, this is not a limitation. The resin layer 20 need not be formed.

EXAMPLES

Next, specific examples of a sound generator according to the present invention will be described. The sound generator according to the second embodiment, which is illustrated in FIGS. 5 to 9, was fabricated. A bimorph piezoelectric element, in which PZT-based piezoelectric layers and electrode layers are stacked, was used as the piezoelectric element 1. The piezoelectric element 1 had a rectangular shape having a length of 36 mm, a width of 14 mm, and a thickness of 0.15 mm. A PET (polyethylene terephthalate) film having a thickness of 0.025 mm was used as the film 3. A portion of the film 3 that is inside the frame members (5*a*, 5*b*) and that functions as the vibrating body 3*a* had a rectangular shape having a length of 60 mm and a width of 30 mm. The reflection member 81, the reflection member 85, the reflection member 86, and the reflection member 88 were made from an acrylic resin. The reflection member 82 and the reflection member 87 were made from SUS (stainless steel). The reflection member 81 and the reflection member 82 had a rectangular shape having a length of 245 mm and a width of 40 mm. The distance between the reflection member 81 and the reflection member 82 was 6 mm.

Figure 11:
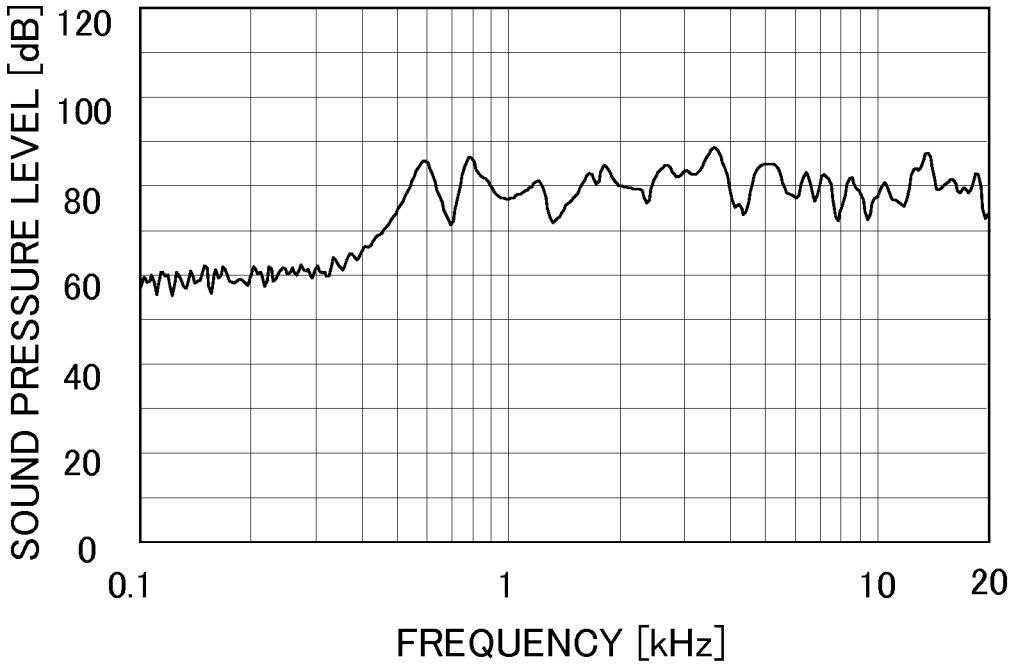
FIG. 11 is a graph representing the characteristics of the sound generator according to the second embodiment of the present invention.
Figure 12:
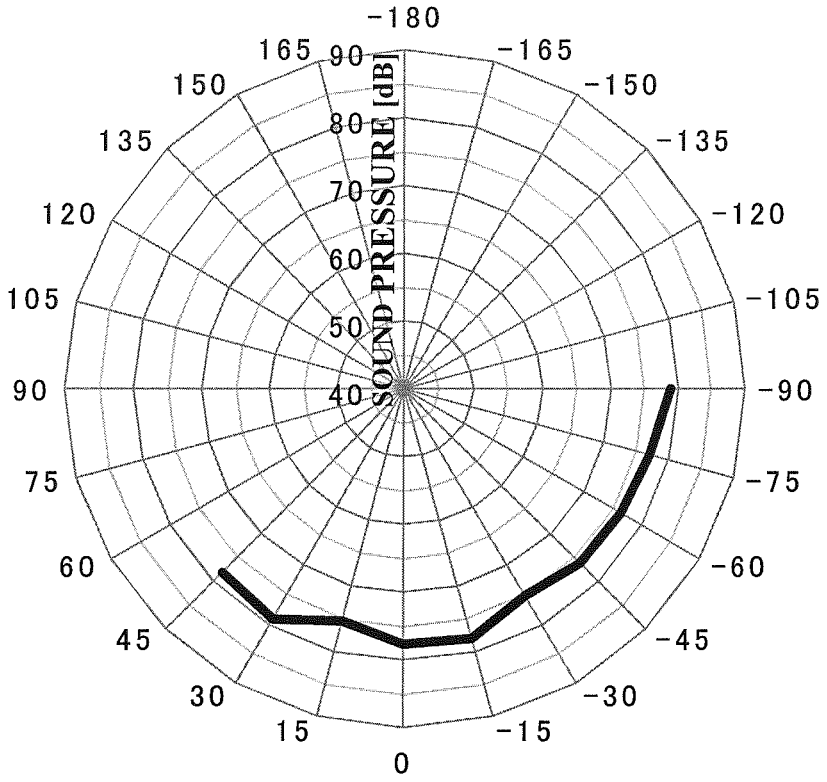
FIG. 12 is a graph representing the characteristics of the sound generator according to the second embodiment of the present invention.

FIGS. 11 and 12 show the characteristics of the sound generator fabricated as described above. FIG. 11 a graph representing the change of the sound pressure according to the frequency of a sound generated by the sound generator. FIG. 11 shows the sound pressure at 1 meter from the sound generator when a sinusoidal voltage having an effective value of 7.5 V was applied to the sound generator. In the graph of FIG. 11, the horizontal axis represents frequency, and the vertical axis represents sound pressure level. FIG. 12 a graph representing the directivity of a sound generated by the sound generator. A sound pressure at 1 meter from the sound generator when a sinusoidal voltage having an effective value of 10 V was applied to the sound generator is plotted. In the graph of FIG. 12, directions from the sound generator are represented by angles that are marked along the circumference, in which 0 represents the +Z direction, −90° represents the −X direction, and 45° (+45°) represents a direction inclined by 45° from the +Z direction toward the +X direction. In this case, the sound pressure in the range of −90° to +45° was measured.

As can be understood from the graph of FIG. 11, in a wide frequency range of 0.1 kHz to 20 kHz, a sufficient sound pressure of 60 dB or higher was obtained; the change in the sound pressure according to the frequency was small; and a low-distortion and high-quality sound could be generated. As can be understood from the graph of FIG. 12, a substantially constant pressure was obtained in the range of −90° to 45° and the directivity was small. From these results, the effectiveness of the present invention was verified.

REFERENCE SIGNS LIST

1 piezoelectric element
3*a* vibrating body
21, 22, 74, 75 opening
30 sound generator

50 electronic device
60 electronic circuit
81, 82, 83*a*, 83*b*, 84*a*, 84*b*, 85, 86, 87, 88 reflection member
91, 92, 93, 94 through-hole

The invention claimed is:

1. A sound generator comprising:

a piezoelectric element;

a vibrating body including a first main surface and a second main surface opposite to the first main surface, the piezoelectric element being disposed on the vibrating body, the vibrating body vibrating due to vibration of the piezoelectric element and generating a sound;

a first reflection member disposed in a first direction side with respect to the vibrating body, and including a first surface that faces the vibrating body and that is inclined with respect to the first main surface of the vibrating body;

a second reflection member disposed in a second direction side, which is opposite to the first direction, with respect to the vibrating body and including a second surface that faces the first surface of the first reflection member with the vibrating body therebetween and that is inclined with respect to the second main surface of the vibrating body;

a first opening facing in a third direction, which is different from the first direction, and connecting a first space between the vibrating body and the first reflection member, to a space outside of the first space; and a second opening facing in a fourth direction, which is different from the second direction and the third direction, and connecting a second space between the vibrating body and the second reflection member, to a space outside of the second space, wherein the piezoelectric element is disposed nearer to the first reflection member than to the second reflection member, and wherein the first reflection member includes a first through-hole extending through a portion of the first reflection member facing the piezoelectric element.

2. The sound generator according to claim 1, wherein, when a fifth direction side is in a direction along the first main surface of the vibrating body and a sixth direction side is in a direction opposite to the fifth direction, an end of the vibrating body in the fifth direction side is closer to the first reflection member than an end of the vibrating body in the sixth direction side, and wherein the piezoelectric element is disposed at a position on the vibrating body in the fifth direction side.

3. The sound generator according to claim 2, wherein, when a distance between the first reflection member and the second reflection member is denoted by D1 and a length of the vibrating body in the fifth direction is denoted by L1, D1<L1.

4. The sound generator according to claim 2, wherein, when a seventh direction is defined as a direction along the first main surface of the vibrating body and perpendicular to the fifth direction, a length of the piezoelectric element in the seventh direction is larger than that in the fifth direction.

5. The sound generator according to claim 4, wherein, when an eighth direction is defined as a direction along the first surface of the first reflection member and perpendicular to the seventh direction, a length of the first through-hole in the eighth direction is larger than that in the seventh direction, wherein one or more second through-holes extending through the portion of the first reflection member facing the piezoelectric element are disposed with a distance from the first through-hole in the seventh direction, and a length of the second through-holes in the eighth direction is larger than that in the seventh direction.

6. The sound generator according to claim 1, further comprising:

a third reflection member disposed in part of a region in which the first reflection member and the second reflection member overlap in the first direction, the third reflection member partitioning a space between the first reflection member and the second reflection member into a space on the first reflection member side and a space on the second reflection member side;

a fourth reflection member connecting the third reflection member to the first reflection member; and a fifth reflection member connecting the first reflection member to the second reflection member, wherein the third reflection member includes a third through-hole, and the vibrating body is disposed on the third reflection member so as to cover the third through-hole, wherein the first opening connects a third space to a space outside of the third space, the third space being surrounded by the vibrating body, the first reflection member, the third reflection member, and the fourth reflection member, wherein the second opening connects a fourth space surrounded by the first to fifth reflection members and the vibrating body to a space outside of the fourth space, and wherein a duct is connected to the second opening.

7. The sound generator according to claim 6, further comprising:

a sixth reflection member that reflects both of a sound emitted from the first opening and a sound emitted from the duct.

8. An electronic device comprising:

the sound generator according to claim 1; and an electronic circuit connected to the sound generator, wherein the electronic device has a function of causing the sound generator to generate a sound.

9. The sound generator according to claim 3, wherein the first reflection member and the second reflection member are disposed in parallel.

10. A sound generator comprising:

a vibrating body including a first main surface and a second main surface;

a sound generating piezoelectric element disposed to the second main surface;

a first reflection member facing the first main surface and inclined with respect to the first main surface; and a second reflection member facing the second main surface and inclined with respect to the second main surface;

wherein the vibrating body and the first reflection member forms a first opening therebetween, and the vibrating body and the second reflection member forms a second opening therebetween, the first opening and the second opening facing different direction, wherein the second main surface comprises a first end portion and a second end portion, a distance between the first end portion and the first reflection member is shorter than a distance between the second end portion and the first reflection member, and wherein the sound generating piezoelectric element is disposed on the first end portion.

11. The sound generator according to claim 10, wherein a distance between the sound generating piezoelectric element and the first reflection member is shorter than a distance between the sound generating piezoelectric element and the second reflection member.

12. The sound generator according to claim 11, wherein the first reflection member includes a first through-hole extending through a portion of the first reflection member facing the sound generating piezoelectric element.

13. The sound generator according to claim 10, wherein a distance between the first reflection member and the second reflection member is shorter than a length of the vibrating body in a direction from the first end portion to the second end portion.

14. The sound generator according to claim 13, wherein the first reflection member includes a first through-hole extending through a portion of the first reflection member facing the sound generating piezoelectric element.

15. The sound generator according to claim 13, wherein the first reflection member and the second reflection member are disposed in parallel.

16. The sound generator according to claim 14, wherein the first reflection member and the second reflection member are disposed in parallel.

17. The sound generator according to claim 10, wherein a width of the sound generating piezoelectric element in a perpendicular direction to the direction from the first end portion to the second end portion is larger than a length of the sound generating piezoelectric element in a parallel direction to the direction from the first end portion to the second end portion.

18. A mobile phone comprising:

a control circuit; and the sound generator according to claim 10 connected to the control circuit;

wherein the control circuit applies voltage to the sound generator, the sound generator generates a sound based on the voltage.

19. The mobile phone according to claim 18 further comprising:

an antenna connected to the control circuit and receiving data based on the control of the control circuit; and wherein the control circuit applies voltage to the sound generator based on the data received by the antenna, the sound generator generates a sound based on the voltage.

* * * * *